United States Patent [19]

Freeman

[11] 4,207,442

[45] Jun. 10, 1980

[54] DRIVER CIRCUIT FOR ELECTROSTATIC TRANSDUCERS

[76] Inventor: Miller L. Freeman, 4221 Kling St., #4, Burbank, Calif. 91505

[21] Appl. No.: 905,886

[22] Filed: May 15, 1978

[51] Int. Cl.[2] ..... H04R 19/02; H04R 3/00

[52] U.S. Cl. ..... 179/111 E; 179/111 R

[58] Field of Search ..... 179/111 E, 111 R

[56] References Cited

U.S. PATENT DOCUMENTS

| | | | |
|---|---|---|---|
| 3,372,245 | 3/1968 | Yoshida et al. | 179/111 R |
| 3,668,335 | 6/1972 | Beveridge | 179/111 R |
| 3,821,492 | 6/1974 | Tamura et al. | 179/111 E |
| 3,894,198 | 7/1975 | Murayama et al. | 179/111 E |

*Primary Examiner*—George G. Stellar

*Attorney, Agent, or Firm*—Edwin A. Oser

[57] ABSTRACT

A driver circuit for an electrostatic transducer which may have a flat or folded configuration. The transducer has a pair of rigid sound transparent stator plates spaced from each other and a flexible, conductive diaphragm disposed between the stator plates. A high voltage is impressed between the stator plates either by a voltage source or by electrets of opposite polarity on the stator plates. The audio signal is applied to the diaphragm through a transformer and a pair of rectifiers connected back to back. Hence, the audio signal is impressed on the diaphragm. The rectifiers are so poled that only a half cycle of the audio signal can be impressed on each of the stator plates. Alternatively, the stator plates are connected to a high voltage rectifier doubler circuit with multiple voltage taps.

9 Claims, 3 Drawing Figures

DRIVER CIRCUIT FOR ELECTROSTATIC TRANSDUCERS

BACKGROUND OF THE INVENTION

1. Field of the Invention.

This invention relates generally to electrostatic transducers, and particularly relates to a driver circuit therefor.

2. Description of the Prior Art.

The present invention may be considered to be an improvement over the applicant's prior U.S. Pat. No. 4,006,713.

Prior art driver circuits for electrostatic tranducers are genreally arranged to drive the stators of the transducer while a direct current voltage is applied between the diaphragm and both stator plates. The diaphragm is supplied with a voltage of one polarity and both stator plates with the other. However, generally the driver circuits are arranged so that the audio signal is also fed back onto the stator plates. This in turn means that the voltages applied to the stator plates vary together with the audio signal. Because the stator plates are fixed and rigid, the portion of the audio signal applied across the stator plates represents a loss of energy and, hence, decreased efficiency.

Furthermore, due to the type of driver circuits known in the past, it has not been possible to apply a DC bias voltage which was unmodulated across the stator plates which is as high as, or higher than the peak audio voltage, It will be evident that the higher the DC bias voltage between the stator plates is, the higher is the resulting efficiency. Also, by having a steady biasing field, the response of the transducer is more linear with respect to the audio modulation impressed on the diaphragm.

It is accordingly an object of the present invention to provide a driver circuit for an electrostatic transducer which overcomes the disadvantages of the prior art.

Another object of the present invention is to provide a driver circuit which makes it possible to create a DC bias field between the stator plates which may be as high as, or higher than the peak audio voltage.

A further object of the present invention is to provide a driver circuit of the type discussed which makes it possible to apply the alternating audio signal onto the diaphragm and to omit the variations of the audio signal on the respective driver plates.

Still another object of the present invention is to supply the required electrostatic field between the stator plates by electrets of the opposite polarity on respective stator plates.

Still a further object of the invention is to eliminate resonance between the transducer and its driving source.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENTS

Figure 1:
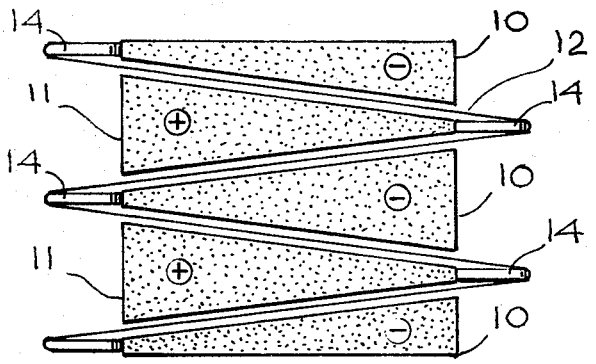
FIG. 1 is a top plan view of an electrostatic transducer of the folded type to which the driver circuit of the invention may be applied.

Referring now to the drawings, there is illustrated in FIG. 1 by way of example, a portion of an electrostatic transducer of the folded type. It will, however, be understood that the driver circuit of the invention may be applied to both the flat and folded type of electrostatic transducer. Examples of such electrostatic transducers have been shown and described in applicant's prior patent above referred to.

The transducer of FIG. 1 includes a first set of stator plates 10 and a second set of stator plates 11. As shown in the drawing, stator plates 10 may, for example, have a negative voltage applied thereto while stator plates 11 have a positive voltage thereon.

The stator plates 10 are spaced from the stator plates 11 and are supplied with a direct current potential thereacross to provide an electrostatic field between the two sets of plates 10 and 11. A diaphragm 12 is disposed between the two sets of stator plates 10 and 11. The diaphragm 12 may be stretched between insulated and conductive supports 14 which, as shown, may consist of insulated and conductive strips. The diaphragm 12 is flexible and electrically conductive. This may be accomplished by providing a conductive coating over the flexible diaphragm, or else the diaphragm may consist of an electrically conductive material. Because the diaphragm is flexible, it is vibratable in accordance with an audio signal. The audio signal may be applied to the diaphragm 12 in a manner to be subsequently explained.

A suitable direct current high voltage may be applied between the two sets of stator plates 10 and 11. This may, for example, be a high voltage source or else a full-wave rectifier. Alternatively, an electret may be disposed on each of the two sets of stator plates 10 and 11. An electret is a permanently polarized piece of dielectric material. It is produced by heating the material and placing it in a strong, electric field during cooling. By way of example, barium titanate ceramics may be polarized in this manner, as well as carnauba wax or mixtures of organic waxes. Hence, a strong, uniform electric field is created between the two oppositely charged electrets. There is no difference between the electric field created by electrets and that created by a steady high voltage applied between the stator plates 10 and 11.

The electrets on the plates 10 may be charged to have a negative polarity while the electrets on the plates 11 may have a positive polarity.

It will be understood that the folded electrostatic transducer of FIG. 1 is only shown by way of example, and other types of transducers may be used instead. It will also be understood that the stator plates, such as 10 and 11, preferably are transparent to sound. Such sound transparent stator plates have been shown, for example, in FIGS. 2 and 3 of the applicant's prior patent, referred to hereinabove. In any case, all that is necessary to produce sound transparent stator plates is to provide them with suitable apertures or windows in the direction in which the sound emerges from or is collected by the transducer.

It will also be understood that an electret is an electrical insulator and, hence, there is no necessity to provide electrical insulation between the diaphragm 12 and the plates 10 or 11 in case the plates are provided with electrets to generate the electric bias field.

It will be realized that any electrical circuit including an inductor and a capacitor, either in parallel or in series, represents a resonant circuit. Such a resonant circuit will, of course, oscillate at a particular frequency. This is highly undesirable in an electrostatic transducer because near the resonant frequency, the transducer will no longer be able to generate a linear response. Such an inductor-capacitor circuit exists in any electrostatic transducer provided with a transformer unless special precautions are taken. The transformer, of course, represents an inductance and the capacitance is formed between the stator plates and the diaphragm.

Figure 2:
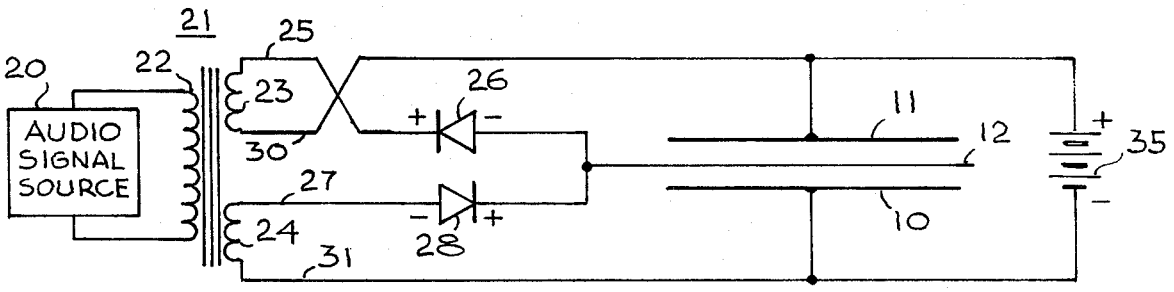
FIG. 2 is a circuit diagram of a driver circuit embodying the present invention and including a high voltage source for the DC bias field.

A driver circuit which will prevent this undesirable resonance is illustrated in FIG. 2, to which reference is now made. FIG. 2 shows a pair of stator plates 10 and 11 and a diaphragm 12 disposed therebetween. The audio signal is generated by an audio signal source 20, the output of which is impressed on a transformer 21 having a primary winding 22 and two secondary windings 23 and 24. The secondary windings 23 and 24 are wound in opposite sense or connected in opposite sense. Thus, the upper terminal 25 of the secondary winding 23 is connected to the cathode of a rectifier 26. The upper terminal 27 of the secondary winding 24 is connected to the anode of a rectifier 28.

The respective other or lower terminals 30 and 31 of the secondary windings 23 and 24 are connected respectively to the stator plates 11 and 10, as shown. The junction point between the anode of rectifier 26 and the cathode of rectifier 28 is connected to the diaphragm 12.

The direct current high voltage may be generated by a battery 35 which is connected across plates 10 and 11. The positive terminal of battery 35 is connected to plate 11, while its negative terminal is connected to plate 10.

It will be realized that the rectifiers 26 and 28 are reverse biased by the battery 35. Thus, a positive potential is applied to the cathode of rectifier 26 from the battery 35 through secondary winding 23. At the same time, a negative potential is applied from the battery 35 through secondary winding 24 to the anode of rectifier 28.

Hence, the rectifiers 26 and 28 are normally open circuited, that is, they will be unable to conduct electric current in the absence of an audio signal. However, on the positive cycle of the audio signal, rectifier 28 will be able to conduct and to charge the diaphragm 12 positively. The negative half cycle of the audio signal will also be applied to the stator plate 10 to provide a return path for the positive portion of the audio signal.

On the other hand, during the negative cycle of the audio signal, the cathode of rectifier 26 will be made negative and, hence, will be able to conduct thereby to charge the diaphragm 12 in a negative direction. At the same time, the positive half cycle of the audio signal is impressed on the stator plate 11 to complete the current path.

However, it will be evident that the full audio signal can never be applied across the plates 10 or 11 because one of the rectifiers 26 or 28 will always be open circuited and, hence, incapable of conducting.

The fact that the return path of the audio signal only goes in one direction due to the fact that one of the rectifiers is always open circuited, is quite important in accordance with the present invention as it prevents oscillation. Since the stator plates 10 and 11 are rigid, they cannot vibrate with the audio signal. Hence, any portion of the audio signal applied to the stator plates reduces the efficiency of the transducer. In other words, the portion of the alternating current audio signal applied to the stators 10 and 11 causes a loss of power due to their fixed capacitance.

Due to the connections of the driver circuit of FIG. 2, it is now possible in accordance with the present invention to apply a direct unmodulated voltage or field between the stators 10 and 11 higher than the peak audio voltage. This bias voltage may be on the order of two times the peak audio signal. This would not be possible with prior art driver circuits for such electrostatic transducers.

It will also be noted that the DC bias voltage provided by battery 35 cannot flow through the secondary windings 23 or 24 because of the provision of the rectifiers 26, 28.

Figure 3:
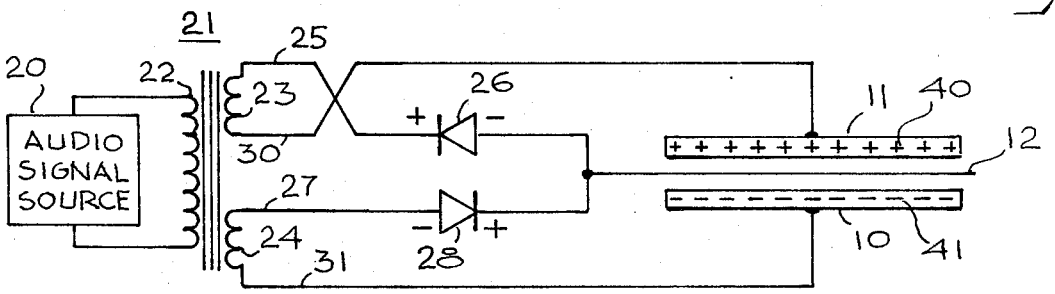
FIG. 3 is a circuit diagram of a modified driver circuit in accordance with the present invention where the stator plates are provided with electrets charged to opposite polarities to provide the necessary bias field.

The high voltage electrostatic biasing field may also be obtained in accordance with the present invention without a battery or voltage source shown at 35 in FIG. 2. This is illustrated in FIG. 3, to which reference is now made. The driver circuit of FIG. 3 is identical with that of FIG. 2. However, associated with the stator plate 11 is an electret 40 which is positively charged. Similarly, the stator plate 10 of FIG. 3 has associated thereto an electret 41 which is negatively charged. Hence, the oppositely charged electrets 40 and 41 provide the necessary biasing field between the stator plates 10 and 11. As a result, an external bias voltage supply, such as 35 in FIG. 2 is eliminated. Additionally, as mentioned before, the electrets 40 and 41 are insulators and no other insulation is needed between the stator plates 10, 11 and the diaphragm 12. It should be noted that the use of electrets to provide the high voltage bias field for electrostatic transducers is not limited to the particular driver circuit of the present invention. Since electrets are insulators, it is feasible to provide an electrostatic field between the stator plates 10 and 11 which is higher than the breakdown voltage between the stator plates.

There has thus been disclosed a driver circuit for electrostatic transducers. Where the circuit includes a transformer, it is disconnected through a pair of rectifiers from the stator plates so that a resonant circuit including an inductor and capacitor in series or parallel is not formed. The high voltage may either be applied by a battery or the like, or by oppositely charged electrets forming part of the respective stator plates.

What is claimed is:

1. A driver circuit for an electrostatic transducer comprising:

a pair of substantially rigid, insulated, sound transparent stator plates spaced from each other;

an electrically conductive, flexible diaphragm disposed between said stator plates;

means for applying a high steady potential between said stator plates;

means for applying an audio signal to said diaphragm; and said means for applying said audio signal including impedence elements coupled between said diaphragm and each of said stator plates for permitting each stator plate to have applied thereto, only one-half cycle of the audio signal.

2. A circuit as defined in claim 1 wherein said means for applying a steady potential between said stator plates consists of a voltage source.

3. A circuit as defined in claim 1 wherein said means for applying a steady potential between said stator plates includes an electret charged to one polarity on one of said stator plates and an electret charged to the opposite polarity on the other one of said stator plates.

4. A driver circuit for an electrostatic transducer comprising:

a pair of substantially rigid, sound transparent, insulated stator plates spaced from each other;

a flexible, electrically conductive diaphragm disposed between said stator plates;

means for applying a high steady potential between said stator plates;

an audio signal source;

a transformer having a pair of secondary windings coupled between said audio signal source and said stators and diaphragm, said secondary windings being wound in opposite sense;

respective opposite ends of said secondary windings being connected to said stator plates; and a pair of rectifiers, each being connected between said diaphragm and one of the remaining ends of said secondary windings of said transformer, said rectifiers being connected to be reverse biased by the direct current voltage, whereby the audio signal is applied to said diaphragm while each of said stator plates is connected to said audio signal source only during respective one-half cycles of the audio signal.

5. A circuit as defined in claim 4 wherein said means for applying a steady potential between said stator plates consists of a voltage source.

6. A transducer as defined in claim 5 wherein the potential between said stator plates is higher than the peak audio voltage.

7. A transducer as defined in claim 5 wherein the potential between said stator plates is on the order of twice the peak audio voltage.

8. A circuit as defined in claim 4 wherein said means for applying a steady potential between said stator plates consists of an electret on one of said stator plates charged to one polarity and an electret on the other one of said stator plates charged to the opposite polarity.

9. In an electrostatic transducer:

a pair of substantially rigid, conductive, sound transparent stator elements, said stator elements being spaced from each other;

a vibratable, electrically conductive element disposed between said stator elements;

electrets of opposite polarity on said stator elements facing said vibratable element for providing a strong electrostatic field therebetween and for insulating said stator elements from said vibratable element; and means for applying to said elements a modulated electric audio signal so that the signal is applied alternately between one of said stator elements and said vibratable element and between the other one of said stator elements and said vibratable element, whereby said vibratable element vibrates solely by the modulations of the electric field between said stator elements due to its electrical conductivity.

* * * * *